US009625849B2

(12) United States Patent
Shimba

(10) Patent No.: US 9,625,849 B2
(45) Date of Patent: Apr. 18, 2017

(54) IMAGE FORMING APPARATUS

(71) Applicant: CANON KABUSHIKI KAISHA, Tokyo (JP)

(72) Inventor: Takeshi Shimba, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/084,245

(22) Filed: Mar. 29, 2016

(65) Prior Publication Data

US 2016/0291501 A1 Oct. 6, 2016

(30) Foreign Application Priority Data

Mar. 31, 2015 (JP) ..... 2015-074304
Dec. 8, 2015 (JP) ..... 2015-239517

(51) Int. Cl.
*G03G 15/04* (2006.01)
*G03G 15/043* (2006.01)

(52) U.S. Cl.
CPC ... *G03G 15/043* (2013.01); *G03G 2215/0132* (2013.01)

(58) Field of Classification Search
CPC ..... G03G 15/043; G03G 2215/0132
USPC ..... 399/4
See application file for complete search history.

(56) References Cited

U.S. PATENT DOCUMENTS

2008/0144132 A1* 6/2008 Koga ..... G03G 15/043 358/475
2012/0275476 A1* 11/2012 Yamashita ..... H01S 5/0683 372/9
2014/0347430 A1* 11/2014 Maeda ..... G03G 15/043 347/118

FOREIGN PATENT DOCUMENTS

JP 8-304723 A 11/1996
JP 3461257 B2 10/2003
JP 2010-76354 A 4/2010
JP 2012-230325 A 11/2012

* cited by examiner

*Primary Examiner* — Hoang Ngo
(74) *Attorney, Agent, or Firm* — Canon USA, Inc. IP Division

(57) ABSTRACT

In a case of changing a first light quantity to a second light quantity which is smaller than the first light quantity, a light quantity changing unit changes a light quantity to a third light quantity, which is smaller than the first light quantity and larger than the second light quantity, before changing the light quantity to the second light quantity, and a third light quantity is a light quantity with which the signal is able to be output in a state where a first threshold is set.

14 Claims, 10 Drawing Sheets

IMAGE FORMING APPARATUS

BACKGROUND OF THE INVENTION

Field of the Invention

The present invention relates to an image forming apparatus in an electrophotographic system.

Description of the Related Art

In an image forming apparatus in an electrophotographic system, a laser light quantity of a scanner which is an exposing unit by which a photosensitive drum is exposed to laser light (hereinafter, laser light quantity) is changed in order to cope with aged deterioration of a member for image formation such as the photosensitive drum, which is caused by being used, in some cases. Moreover, for electrically collecting charged (positively charged or negatively charged) toner into a residual toner container used for the desired photosensitive drum (hereinafter, electrostatic cleaning), the laser light quantity may be switched to thereby adjust potential of the photosensitive drum. As above, it is necessary to enable correct acquisition of a BD signal regardless of the laser light quantity so that the laser light is correctly emitted even in a configuration in which the laser light quantity is changed.

Then, in Japanese Patent No. 3461257, proposed is a configuration of a circuit which acquires a BD signal from a scanner laser, in which a peak of a current passing through a BD signal acquiring circuit is held. In this configuration, a slice level corresponding to a fluctuation of a laser light quantity is set by a circuit which changes the slice level according to the laser light quantity.

However, in a configuration in which a peak hold circuit is used as the BD signal acquiring circuit, when switching a state of a laser light quantity from a large state to a small state, a discharge time of a peak hold capacitor of the peak hold circuit becomes longer than a laser light quantity switching time in some cases. In this case, when the slice level is greater than the laser light quantity in a period during which the slice level shifts to a level suitable for a small laser light quantity, it is difficult to acquire a BD signal. When the BD signal becomes unable to be acquired, there is a case where it is difficult to emit laser light at a suitable timing. In addition, rotation control of a polygon mirror is not controlled suitably and rotation speed becomes out of target, so that it takes long time to acquire the BD signal again and return the rotation to be regular rotation again. As a result thereof, a time required to start image formation becomes long in some cases.

SUMMARY OF THE INVENTION

An aspect of the invention provides an image forming apparatus, including: a light source which emits light radiated to a photosensitive member; a deflection unit which reflects the light emitted from the light source and radiates the reflected light to the photosensitive member to form a latent image; a light receiving unit configured to receive the light which is emitted from the light source and reflected by the deflection unit; a signal output unit which outputs a signal based on a value related to the received light; a light quantity changing unit which changes a light quantity that the light source emits; and a setting unit which sets a threshold for outputting the signal based on the value related to the received light, in which in a case where the light receiving unit receives light which is emitted from the light source with a first light quantity, the setting unit sets a first threshold based on a value related to a first received light corresponding to the first light quantity, and in a case of changing the first light quantity to a second light quantity which is smaller than the first light quantity, the light quantity changing unit changes the light quantity to a third light quantity, which is smaller than the first light quantity and larger than the second light quantity, before changing the light quantity to the second light quantity, and the third light quantity is a light quantity with which the signal is able to be output in a state where the first threshold is set.

Further features of the present invention will become apparent from the following description of exemplary embodiments with reference to the attached drawings.

DESCRIPTION OF THE EMBODIMENTS

Example 1

Example 1 is about a method for eliminating a period, in which a BD signal (horizontal synchronization signal) is unable to be acquired, by performing laser light quantity switching in two stages when switching a state of a laser light quantity from a large state to a small state.

[Image Forming Apparatus]

Figure 1A:
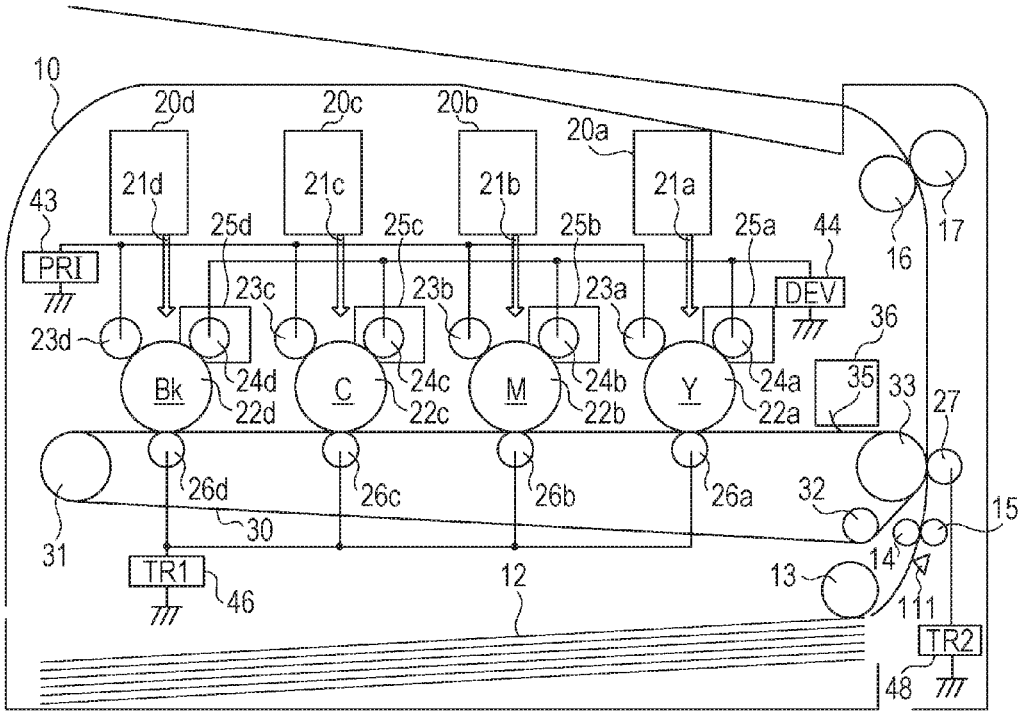
FIG. 1A is a cross sectional view illustrating a configuration of a color image forming apparatus of an in-line system (four-drum type) and FIG. 1B is a view illustrating a configuration of a scanner unit.
Figure 1B:
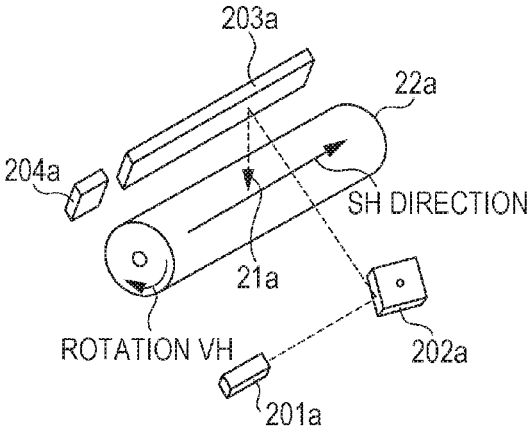

FIGS. 1A and 1B are configuration views of a color image forming apparatus 10 of an in-line system (four-drum type). A recording medium 12 which is let out by a pickup roller 13 has a front edge detected by a registration sensor 111, and then, is stopped being conveyed once at a position where the front edge slightly passed through a conveyance roller pair 14 and 15.

Meanwhile, scanner units 20*a* to 20*d* sequentially radiate laser light 21*a* to 21*d* onto photosensitive drums 22*a* to 22*d* serving as photosensitive members, which are rotationally driven, with a desired laser light quantity. At this time, the photosensitive drums 22*a* to 22*d* have been charged by charging rollers 23*a* to 23*d* in advance. A charging high-voltage power supply circuit 43 serving as a power supply used for charging applies a voltage to each of the charging rollers 23*a* to 23*d*, a voltage of, for example, −1200 V is output from each of the charging rollers 23*a* to 23*d*, and surfaces of the photosensitive drums 22*a* to 22*d* are charged with, for example, −700 V. When forming electrostatic latent images by radiating the laser light 21*a* to 21*d* with such charging potential, potential of a part in which the electrostatic latent images are formed becomes, for example, −100 V. A developing high-voltage power supply circuit 44 serving as a power supply used for development applies a voltage to each of developing sleeves 24*a* to 24*d*. Developing portions 25*a* to 25*d* and the developing sleeves 24*a* to 24*d* output a voltage of, for example, −350 V, and put toner onto the electrostatic latent images on the photosensitive drums 22*a* to 22*d* to form toner images on the photosensitive drums. A primary transfer high-voltage power supply circuit 46 serving as a power supply used for transfer applies a voltage to primary transfer rollers 26*a* to 26*d*. The primary transfer rollers 26*a* to 26*d* output a positive voltage of, for example, +1000 V, and transfer the toner images on the photosensitive drums 22*a* to 22*d* onto an intermediate transfer belt 30 (endless belt) serving as an intermediate transfer member.

Note that, a group of members of the charging rollers 23*a* to 23*d*, the developing portions 25*a* to 25*d*, and the primary transfer rollers 26*a* to 26*d*, which includes the scanner units 20*a* to 20*d* and the photosensitive drums 22*a* to 22*d* and which directly relates to formation of the toner images, is referred to as an image forming unit. In some cases, it may be referred to as the image forming unit without including the scanner unit 20. Moreover, each of members which is arranged in a proximity to a periphery of the photosensitive drum 22*a* to 22*d* and acts on the photosensitive drum 22*a* to 22*d* (the charging rollers 23*a* to 23*d*, the developing portions 25*a* to 25*d*, and the primary transfer rollers 26*a* to 26*d*) is referred to as a processing unit. In this manner, a plurality of types of members may correspond to the processing unit.

The intermediate transfer belt 30 is driven by rollers 31, 32, and 33 so as to circulate, and conveys the toner images to a position of a secondary transfer roller 27. At this time, the recording medium 12 is conveyed so that its timing is coincident with that of the conveyed toner images at the position of the secondary transfer roller 27, and a secondary transfer high-voltage power supply circuit 48 applies a voltage to the secondary transfer roller 27 accordingly. Thereby, the toner images are transferred onto a recording material (onto the recording medium 12) from the intermediate transfer belt 30 by the secondary transfer roller 27.

The toner images on the recording medium 12 are then subjected to heat fixing by a fixing roller pair 16 and 17, and thereafter the recording medium 12 is output to outside the apparatus. In this case, toner which is not transferred to the recording medium 12 from the intermediate transfer belt 30 by the secondary transfer roller 27 is collected into a residual toner container 36 by a cleaning blade 35. Here, as to each reference sign, alphabetic characters a, b, c, and d denote a configuration and a unit of yellow, magenta, cyan and black, respectively.

Note that, though the image forming apparatus 10 having the intermediate transfer belt 30 has been explained in the description above, the invention is able to be used also for an image forming apparatus of a different system. The invention is able to be used also for, for example, an image forming apparatus which adopts a system which includes a recording material conveying belt and directly transfers a toner image developed on each of the photosensitive drums 22 onto a transfer material (recording material) conveyed by the recording material conveying belt (endless belt).

[Explanation of Scanner Unit]

FIG. 1B is a view illustrating a configuration of the scanner unit 20*a* which radiates the laser light 21*a* to the photosensitive drum 22*a*. Since each of the scanner units 20*b* to 20*d* has a configuration similar to that of the scanner unit 20*a* and is controlled similarly thereto, description will be given below for the scanner unit 20*a* representatively. 201*a* denotes a laser light source having a semiconductor laser which emits laser light, 202*a* denotes a polygon mirror (rotating polygon mirror), and 203*a* denotes a mirror, which constitutes an optical system for exposure. 22*a* denotes a photosensitive member. 204*a* denotes a horizontal scan detecting circuit (hereinafter, BDIC circuit), which synchronizes a timing of horizontal scan of one line and a timing of rotation of the photosensitive member by a light receiving element which receives the laser light. The laser light emitted from the laser light source 201*a* is reflected and deflected by the polygon mirror 202*a*, which is rotationally driven by a scanner motor 331 (refer to FIG. 3), and radiated to the photosensitive drum 22*a* via the mirror 203*a*. When a spot of the laser light, which is formed on the photosensitive drum 22*a*, moves in a rotation axial direction of the photosensitive drum 22*a* in accordance with rotation of the polygon mirror 202*a*, horizontal scan is performed. The BDIC (signal outputting unit) 204*a* receives laser light for every single horizontal scan, and outputs a signal based thereon. Based on the signal output from the BDIC 204*a*, a timing of horizontal scan in an SH direction and a timing of scan in a rotational direction VH of the photosensitive member are synchronized. Note that, the developing portion, a charging portion, and a conveying unit of the recording medium are omitted in FIG. 1B.

[Explanation of BDIC Circuit Configuration]

Figure 2A:
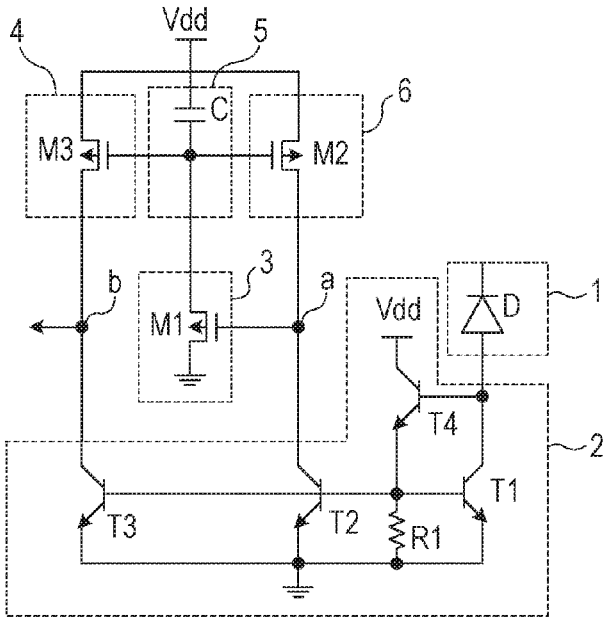
FIG. 2A is a circuit configuration of a BDIC and FIG. 2B is a characteristic diagram indicating a relation of a current and an IC output of the BDIC circuit.

FIG. 2A is a circuit configuration of the BDIC 204*a*. In this figure, 1 denotes a signal supplying unit which supplies a current signal (here, photodiode D), and 2 denotes a current mirror circuit which is connected to the photodiode D and has a first output terminal a and a second output terminal b for output. In addition, 3 denotes a switching unit which is controlled based on a voltage value or a current value of the first output terminal a (here, PMOS transistor M1), and 4 denotes an active load which is connected to the second output terminal b (here, PMOS transistor M3). Further, 5 denotes a capacitance unit which holds a peak value of the voltage value or the current value (here, capacitance C), and 6 denotes an active load which is connected to the first output terminal a (here, PMOS transistor M2). Note that, in a case where a capacitance value of a parasitic wiring capacitance or a parasitic gate capacitance has a sufficient value, the capacitance unit 5 may not be formed particularly as a capacitance element.

The current mirror circuit 2 is composed of bipolar transistors T1 to T3 bases of which are commonly connected, a bipolar transistor T4 emitter of which is connected to the connection of the commonly connected bases, and an electrical resistance R1 one terminal of which is connected to the connection of the commonly connected bases. A collector of the bipolar transistor T4 is connected to a power supply (Vdd) serving as a reference voltage source, and a base thereof is connected to an anode side of the photodiode D and a collector of the bipolar transistor T1. Note that, to a photodiode having PN junction, a reverse bias voltage is normally applied.

A size ratio of the bipolar transistor T1 to the bipolar transistors T2 and T3 is 1:N (N>1), and a size ratio of the PMOS transistor M2 to the PMOS transistor M3 is 10:M (M<10).

An operation of peak hold in the aforementioned circuit will be described here. At present, potential of gate electrodes of the PMOS transistors M2 and M3 is immediately near a power supply voltage Vdd, and the PMOS transistors M2 and M3 are in an off state where almost no current flows. In a state where a photocurrent is not input, no current flows through the current mirror circuit 2, so that potential of the first and second output terminals a and b which are in a floating state is near Vdd.

At this time, when light enters the photodiode D, a current corresponding to an entrance light quantity (quantity of light received by the photodiode D) flows, and base potential of the bipolar transistor T4 base of which is connected to the photodiode D is raised. Then, a current flows through the NPN bipolar transistor T4. Accordingly, base potential of the bipolar transistors T1 to T3 bases of which are commonly connected to the emitter of the bipolar transistor T4 is also raised. As described above, the size ratio of the bipolar transistors T1 to T2 and T3 is 1:N, and a photocurrent flows through the bipolar transistor T1 and a current of N times of the photocurrent flows through the bipolar transistors T2 and T3.

However, since the PMOS transistor M2 is in the off state, the current does not flow via the PMOS transistor M2. When the potential of the first output terminal a is decreased from a level of Vdd and becomes closer to a ground potential as a reference voltage, the switching unit composed of the PMOS transistor M1 becomes in an on state. Then, the gate potential of the PMOS transistor M2 is decreased and becomes closer to the ground potential as the reference voltage, and the PMOS transistor M2 becomes in the on state, so that the current is allowed to flow.

Here, when a gate-source potential difference of the PMOS transistor M2 is Vgs2, a quantity of a current which is allowed to flow by the PMOS transistor M2 (IDpm2) is provided by $IDpm2=\beta 2\times(Vgs2-Vth)^2$. In this case, β2 is a transconductance of a MOS transistor. When the photocurrent is represented as Ip, in the case of a condition (1) $\beta 2\times(Vgs2-Vth)^2<N\times Ip$, the first output terminal a is at a Low level. In the case of a condition (2) $\beta 2\times(Vgs2-Vth)^2>N\times Ip$, the first output terminal a is at a High level. Since the PMOS transistor M2 is the active load, at a moment when the condition (2) is satisfied, the first output terminal a immediately becomes at the High level, and the switching unit composed of the PMOS transistor M1 is closed. As a result thereof, a voltage which satisfies a relation of $IDpm2=\beta 2\times(Vgs2-Vth)^2=N\times Ip$ is written in the gate electrode (or the gate electrode and a capacitance C1) of the PMOS transistor M2, thus making it possible to achieve peak hold.

Next, setting and an output of a slice level (threshold) will be described. Since the size ratio of the PMOS transistor M2 to the PMOS transistor M3 is 10:M (M<10), a current supply capability of the PMOS transistor M3 is M/10 (M<10) of that of the PMOS transistor M2. When taking the formula of the condition (1) into consideration by applying it to the PMOS transistor M3, the current supply capability is M/10, so that the second output terminal b performs an output at the Low level with a current value of M/10 of that of a peak current value. That is, with M/10 of a light quantity of a peak light quantity, the second output terminal b outputs a signal at the Low level.

Note that, though a method of setting the threshold by using a current signal supplied from a signal supplying unit 1 (photodiode D) in the BDIC 204*a* has been described here as one example, there is no limitation thereto. For example, it is also possible to set the threshold by arranging the photodiode D as the signal supplying unit in a direction opposite to a direction, in which laser light is radiated from the laser light source 201*a*, and supplying a current signal in accordance with the laser light.

[Explanation of Output of BDIC Circuit]

Figure 2B:
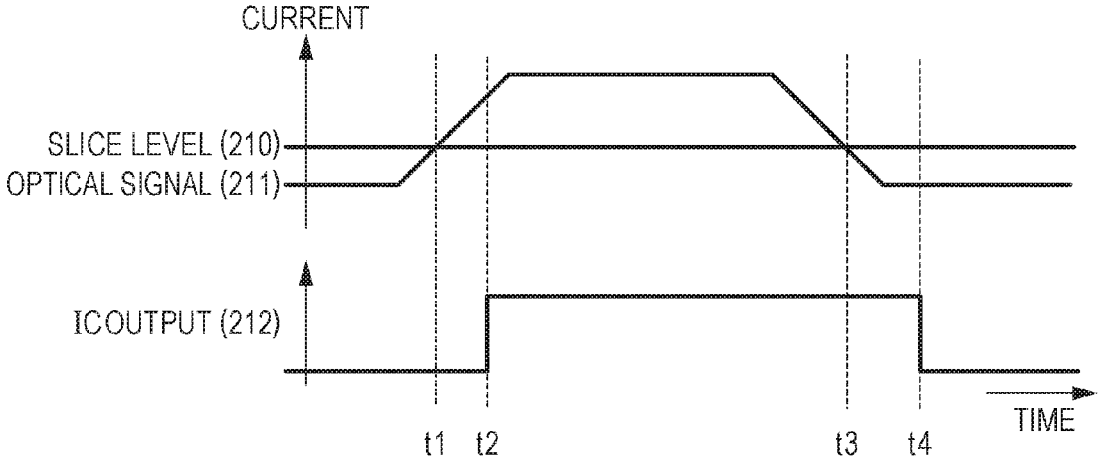

FIG. 2B is a characteristic diagram indicating a relation of a current, which is caused to flow by an input optical signal (211) obtained by receiving light with the photodiode D, and an IC output (212). Here, the optical signal (211) has a value proportional to a light quantity received with the photodiode D. The IC output (212) is obtained by inverting an output of the second output terminal b of FIG. 2A. When an input optical signal equal to or more than a certain slice level (210) (equal to or more than the threshold) is input at a time t1, the IC output becomes at an H level from an L level near a time t2 with a certain delay time. In the above-described circuit, the slice level (210) is regulated by the signal supplying unit 1, the current mirror circuit 2, the switching unit 3, the active load 4, the capacitance unit 5, and the active load 6. Similarly, when the input optical signal becomes equal to or less than the slice level (210) at a time t3, the IC output is inverted near a time t4.

[Explanation of Functional Block Diagram]

Figure 3:
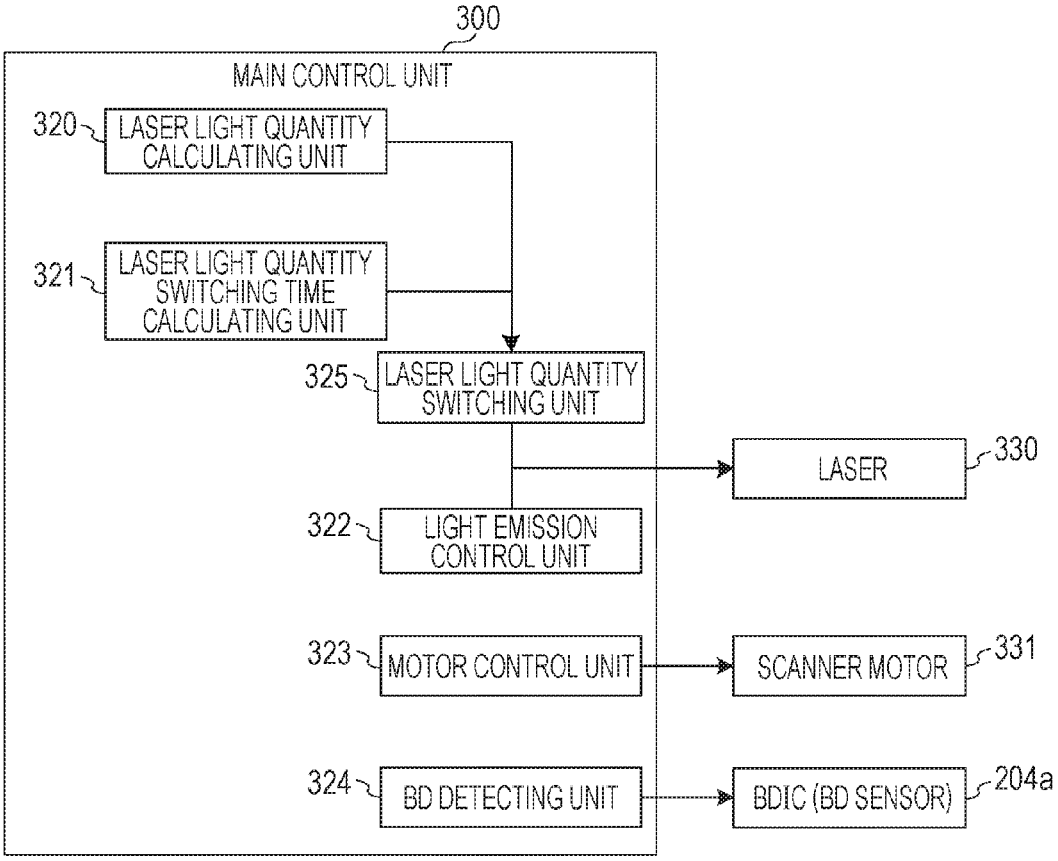
FIG. 3 is a functional block diagram of a main control unit.

FIG. 3 is a functional block diagram of a main control unit 300 (hereinafter, represented as a control unit 300). A laser 330, the scanner motor 331, and the BDIC 204*a* indicate hardware. In addition, each of a laser light quantity calculating unit 320, a laser light quantity switching time calculating unit 321, a light emission control unit 322, a motor control unit 323, a BD detecting unit 324, and a laser light quantity switching unit (light quantity changing unit) 325 indicates a functional block.

In the case of controlling the scanner units 20*a* to 20*d*, based on a cycle of a BD signal output from the BDIC 204*a*, the motor control unit 323 controls the scanner motor 331 so that a rotation speed of the polygon mirror 202*a* is stabilized at a target speed. The control unit 300 switches the light quantity at the laser light quantity switching unit 325 based on a laser light quantity determined by the laser light quantity calculating unit 320 and a laser light quantity switching time determined from a time, which is measured when a laser light quantity is switched, by the laser light quantity switching time calculating unit 321. Based thereon, the light emission control unit 322 controls laser light emission. The BD detecting unit 324 detects the BD signal output from the BDIC 204*a*.

[Explanation of Output of BDIC when Laser Light Quantity is Switched in Conventional Art]

Figure 9A:
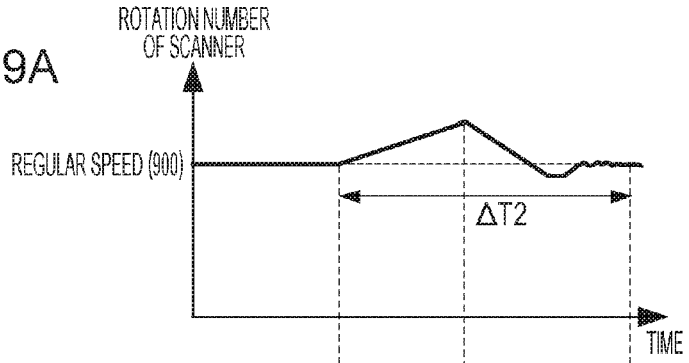
FIGS. 9A to 9C are timing charts of control of light quantity switching related to a conventional art.
Figure 9B:
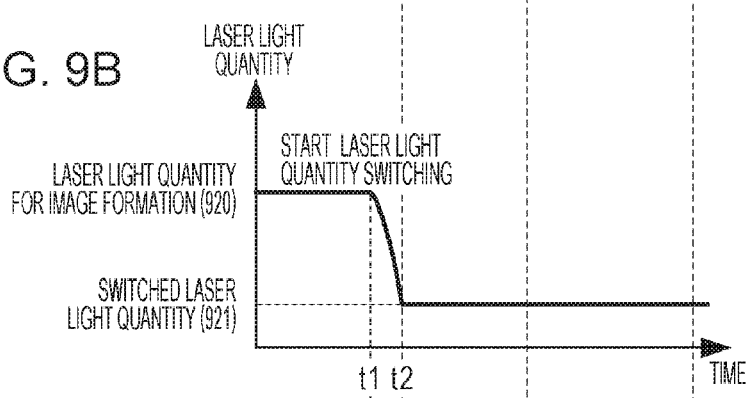
Figure 9C:
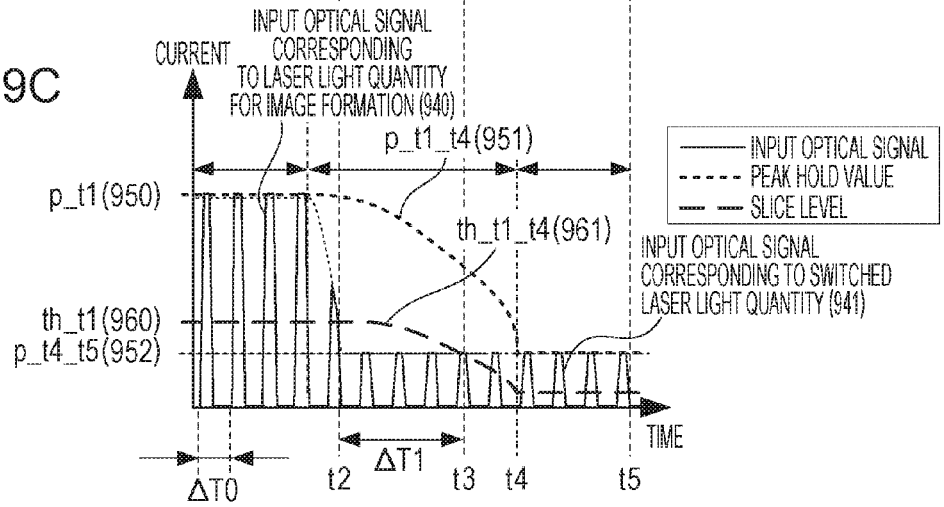

Next, conventional control of laser light quantity switching will be described by using FIGS. 9A to 9C. FIG. 9A illustrates a rotation speed of the scanner (rotation speed of the polygon mirror 202*a*). FIG. 9B illustrates a light quantity of the semiconductor laser (201*a*). FIG. 9C illustrates a relation of a current, which flows correspondingly to a light quantity received by the photodiode D (signal supplying unit 1) when the BDIC (204*a*) is irradiated with light, a peak hold value, and a slice level as a threshold which is set correspondingly to the received light quantity. The current which flows when the BDIC (204*a*) is irradiated with light is the current signal of the signal supplying unit 1 of FIG. 2A. The peak hold value is a peak value of the voltage value or the current value of the capacitance unit 5 of FIG. 2A. The slice level is a current supply capability of the active load 4 which is connected to the second output terminal b of FIG. 2A.

After the rotation speed of the scanner is stabilized at a regular speed (900), the control unit 300 performs exposure onto a drum surface to thereby form an electrostatic latent image. At this time, the laser light quantity is a laser light quantity for image formation (920), and, into the BDIC 204*a*, an optical signal (940) is input in a rotation cycle ΔT0 of the polygon mirror (202*a*) and a current flows. At this time, a peak hold circuit holds a peak hold value p_t1 (950). Moreover, a slice level th_t1 (960) is kept constant by the peak hold circuit. Here, the laser light quantity is switched from the laser light quantity for image formation (920) to a switched laser light quantity (921) at the time t1.

The laser light quantity is switched to the switched laser light quantity (921) by the time t2. At this time, an input optical signal corresponding to the laser light quantity for image formation (940), which is input to the BDIC 204*a*, is also similarly switched to an input optical signal corresponding to the switched laser light quantity (941) by the time t2. Here, since the peak hold circuit holds the peak, a delay occurs with respect to the input optical signal (941), which is input to the BDIC 204*a*, until a discharge time of the circuit (time t4) elapses.

When taking this delay time into consideration, a peak hold value p_t1_t4 (951) is to be switched by the time t4. Moreover, similarly to the peak hold value, a slice level th_t1_t4 (961) is also to be switched by the time t4 when the discharge time of the peak hold circuit elapses.

At this time, during ΔT1 which is from the time t2 to the time t3, the input optical signal corresponding to the switched laser light quantity (941) is lower than the slice level (threshold) th_t1_t4 (961). Accordingly, the output of the BDIC 204*a* becomes Low, so that the BD detecting unit 324 becomes unable to detect a BD signal correctly. As a result thereof, the motor control unit 323 judges that the rotation speed of the scanner is low and performs acceleration control, and the rotation speed of the scanner becomes higher than the regular speed. Thereafter, a slice level (962) becomes lower than the input optical signal corresponding to the switched laser light quantity (941) at the timing when the time t3 has elapsed, and the BD detecting unit 324 becomes able to detect a BD signal correctly after the time t3. At this time, the motor control unit 323 detects, from the detected BD signal, that the scanner rotates with a higher speed than the target speed, and performs deceleration control to perform control so as to converge the rotation speed to the target speed (regular speed (900)).

Finally, after a predetermined time has elapsed (time t5) and the rotation speed of the scanner has converged, the control unit 300 becomes able to control a quantity of exposure with respect to the drum surface. In this manner, a period during which a BD signal is unable to be acquired (ΔT1) occurs when the laser light quantity is switched, and the scanner is accelerated, so that a waiting time (ΔT2) until exposure is allowed after the convergence occurs.

[Explanation of Timing Chart of Example 1]

Figure 4:
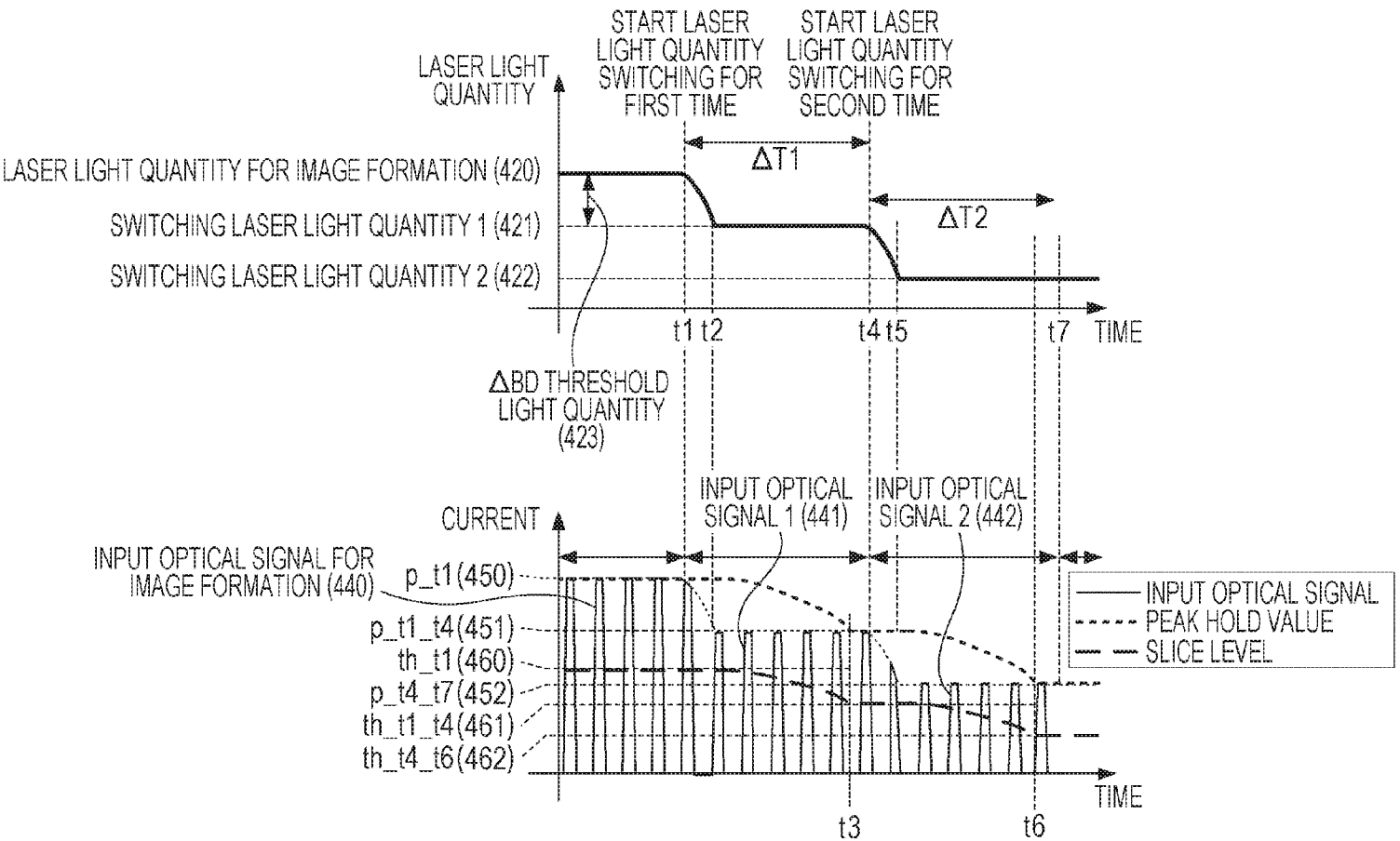
FIG. 4 is a timing chart of control of light quantity switching related to Example 1.

FIG. 4 is a timing chart related to Example 1 in a case where the laser light quantity is switched in two stages so that it is prevented that a BD signal is unable to be acquired. Note that, in FIG. 4, the input optical signal is a signal generated in the BDIC 204*a* when the photodiode D receives light of a set laser light quantity, and the current signal of the signal supplying unit 1 in FIG. 2A. In addition, the peak hold value is a value corresponding to the input optical signal output by a peak hold operation of the peak hold circuit of the above-described BDIC 204*a*, and a peak value of the voltage value or the current value of the capacitance unit 5 of FIG. 2A. Further, the slice level (threshold) is a value corresponding to the input optical signal set by the above-described BDIC 204*a*, and the current supply capability of the active load 4 which is connected to the second output terminal b of FIG. 2A.

First, the control unit 300 activates the scanner unit 20. Next, after the rotation speed of the scanner is stabilized at the regular speed, exposure is performed with respect to the drum surface and thereby an electrostatic latent image is formed. At this time, the laser light quantity is a laser light quantity for image formation (first light quantity) (420), an input optical signal for image formation (440) is input to the BDIC 204*a*, and the peak hold circuit holds a peak hold value p_t1 (450). A slice level th_t1 (first threshold) (460) is being kept constant by the peak hold circuit.

In order to start laser light quantity switching for the first time, the control unit 300 calculates the number of times of switching, a switching light quantity, and a switching time, at a time t1. First, as to the number of times of switching, the number of times of light quantity switching N (N=integer) and a light quantity which is not lower than a BD threshold at a time of light quantity switching are calculated from a ΔBD threshold light quantity (423). Here, the ΔBD threshold light quantity (423) is a value determined by an element of a circuit, which depends on manufacturing variations of the element or variations of temperature characteristics, but is calculated with a value fixed by taking the variations into consideration, in Example 1. As to the number of times of switching N, N (integer) which satisfies a formula below is obtained.

$$(\Delta BD \text{ threshold light quantity} \times (N-1)) \leq (\Delta \text{switching light quantity}) < (\Delta BD \text{ threshold light quantity} \times N) \quad \text{(formula 1)}$$

$$\text{Here, } (\Delta \text{switching light quantity}) = (\text{light quantity for image formation}) - (\text{switched light quantity}) \quad \text{(formula 2).}$$

An n-th switching laser light quantity at this time (421 or 422) is obtained from following formulas with the laser light quantity for image formation (420) and with the number of times of switching as n.

In the case of n<N, $$(n\text{-}th \text{ switching laser light quantity}) = (\text{light quantity for image formation}) - (\Delta BD \text{ threshold light quantity} \times n) \quad \text{(formula 3).}$$

In the case of n=N, $$(n\text{-}th \text{ switching laser light quantity}) = (\text{switched light quantity}) \quad \text{(formula 4).}$$

Further, the laser light quantity switching times ΔT1 and ΔT2 are able to be calculated from a peak hold time of the peak hold circuit. The peak hold time is a time ΔT0 from the time t1 at which laser light quantity switching is started for the first time to the time t3 at which the peak hold value is stabilized. Since the peak hold time takes a different value depending on a circuit configuration, the manufacturing variations of the element, and the variations of the temperature characteristics, a case where the fixed time ΔT1 and ΔT2 which have values larger than ΔT0 by taking the circuit configuration, the manufacturing variations of the element, and the variations of the temperature characteristics into consideration are used is described here.

Based on a result of the aforementioned calculation, the laser light quantity switching unit 321 executes the start of the laser light quantity switching for the first time at the time t1, and waits for the laser light quantity switching time ΔT1. That is, the laser light source 201*a* is caused to emit light for a predetermined period as ΔT1 so that the BDIC 204*a* is able to receive light of the switching laser light quantity 1 from the laser light source 201*a* for a plurality of times.

At this time, the input optical signal to be input to the BDIC 204*a* is changed from the input optical signal for image formation (440) to an input optical signal 1 (441) corresponding to the switching laser light quantity 1 (third light quantity) (421). Accordingly, after the time t3 has elapsed, a peak hold value p_t1 (450) becomes in a state where a difference of the input optical signal for image formation (440) and the input optical signal 1 (441) is discharged and a peak value p_t1_t4 (451) of the input optical signal 1 (441) is held. Here, the slice level th_t1 (460) changes, linked with the peak hold value, to a slice level th_t1_t4 (second threshold) (461). Here, the input optical signal for image formation (440) and the input optical signal 1 (441) which are input to the BDIC 204*a* are controlled so as to be larger than the slice level th_t1 (first threshold) (460) and the slice level th_t1_t4 (second threshold) (461).

Next, the laser light quantity switching unit 321 starts laser light quantity switching for the second time at a time t4. Since n=2 and N=2, a laser light quantity for the second switching becomes a switched light quantity (422) from the formula 4.

Based on a result of the aforementioned calculation, the laser light quantity switching unit 321 executes the start of the laser light quantity switching for the second time at the time t4, and waits for the laser light quantity switching time ΔT2. At this time, the input optical signal to be input to the BDIC 204*a* is changed from the input optical signal 1 (441) to an input optical signal 2 (442) corresponding to the switching laser light quantity 2 (second light quantity) (422). Accordingly, after a time t6 has elapsed, the peak hold value p_t1_t4 (451) becomes in a state where a difference of the input optical signal 1 (441) and the input optical signal 2 (442) is discharged and a peak value p_t4_t7 (452) of the input optical signal 2 (442) is held. Here, the input optical signal 2 (442) which is input to the BDIC 204*a* is controlled so as to be larger than the slice level th_t1_t4 (second threshold) (461) and a slice level th_t4_t6 (third threshold) (462). The control unit 300 becomes able to control an exposure quantity with respect to the drum surface, at a time point of a time t5 at which light quantity switching has completed. Alternately, next image formation is allowed to be executed.

One example of the light quantity switching time will be described. In a case where the time ΔT1 which is needed until the threshold follows the switching is 125 msec, a specific switching method is as followed. The control unit 300 performs switching from the laser light quantity for image formation (first light quantity) (420) to the switching laser light quantity 1 (third light quantity) (421), and then light emission is performed with the switching laser light quantity 1 (third light quantity) for at least ΔT1 (125 msec) or more. In this manner, by defining a light emission time to be a time or more, during which the threshold is set, the slice level (threshold) is to be followingly switched from the slice level th_t1 (first threshold) (460) to the slice level th_t1_t4 (second threshold) (461). After the threshold followed the switching, the control unit 300 performs switching to the switching laser light quantity 2 (second light quantity) (422) and light emission is performed.

Next, one example of a specific situation where light quantity switching is performed will be described. The light quantity switching is performed, for example, when the photosensitive drum is exposed to laser light of the switched light quantity and potential of the photosensitive drum is adjusted and thereby charged (positively charged or negatively charged) toner on the intermediate transfer member is collected into the residual toner container for the desired photosensitive drum (electrostatic cleaning). In order to collect the charged (positively charged or negatively charged) toner into the residual toner container for the desired photosensitive drum, there is a case where the charged (positively charged or negatively charged) toner is caused to pass through the photosensitive drum in an upstream side of the desired photosensitive drum so as not to be collected therein.

Figure 10:
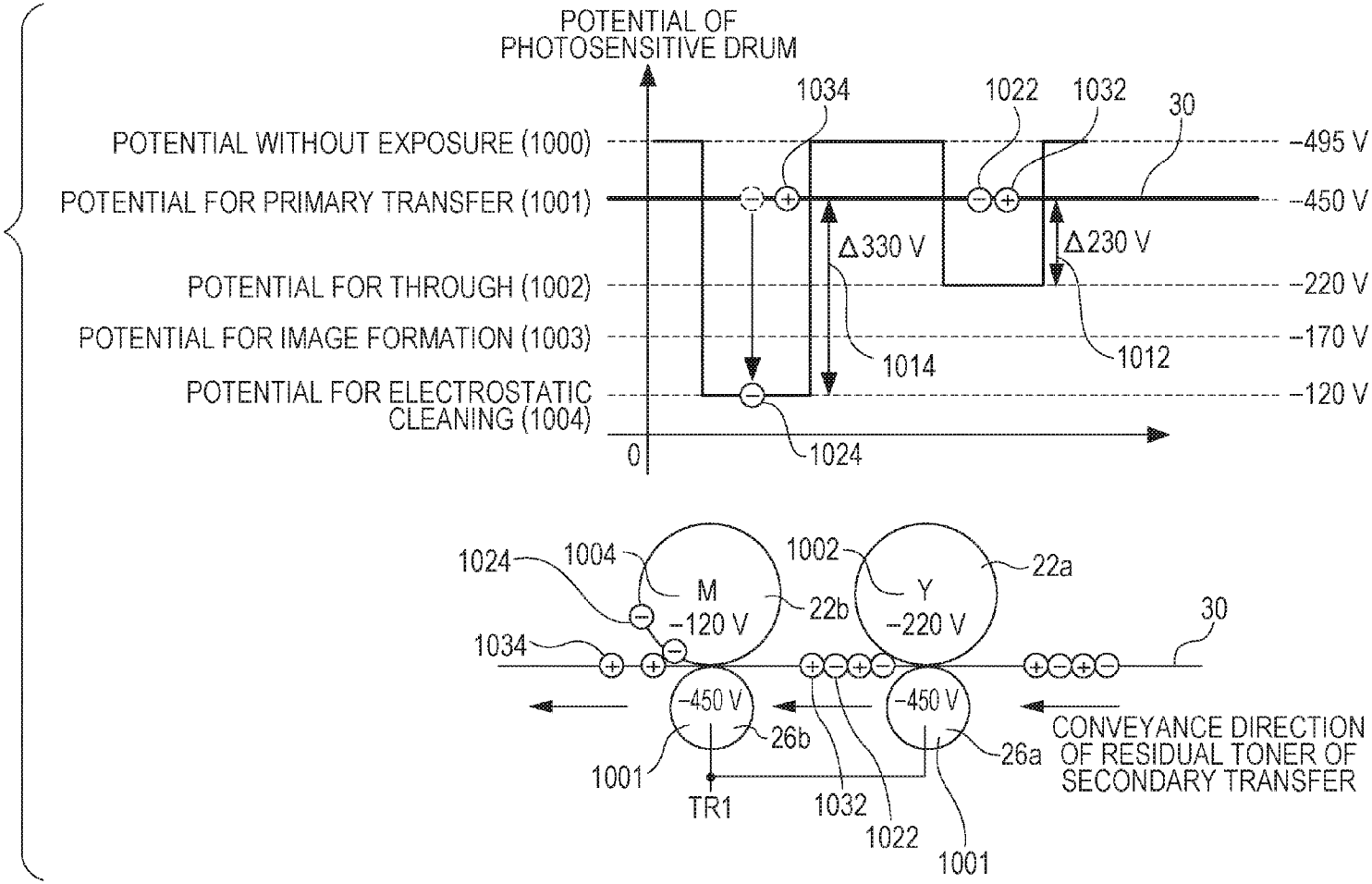
FIG. 10 is a view of a specific example of light quantity switching related to Example 1.

A specific example is illustrated in FIG. 10. Though description will be given here by selecting stations of yellow (Y) and magenta (M) as one example, similar control is able to be performed also as to the other colors. Potential of the primary transfer rollers 26*a* and 26*b* is −450 V (1001), potential of the photosensitive drum which is not exposed to light is −495 V (1000), and potential of the photosensitive drum which is exposed to laser light of the laser light quantity for image formation (420) is −170 V (1003). In this case, with respect to the Y station, the control unit 300 exposes the photosensitive drum 22*a* to light by performing switching to a laser light quantity for through (light quantity smaller than that for image formation) to thereby cause the potential of the photosensitive drum 22*a* to be −220 V (1002). As a result thereof, by reducing a difference of the potential of the photosensitive drum 22*a* and the potential of the primary transfer roller 26*a* (Δ230 V (1012)), control is performed so that collection of negatively charged toner (1022) into the photosensitive drum 22*a* is suppressed.

With respect to the M station which is arranged in a downstream side of the Y station, the control unit 300 exposes the photosensitive drum 22*b* to light by performing switching to a laser light quantity for electrostatic cleaning (light quantity larger than that for image formation) to thereby causes potential of the photosensitive drum 22*b* to be −120 V (1004). As a result thereof, by increasing a difference of the potential of the photosensitive drum 22*b* and the potential of the primary transfer roller 26*b* (Δ330 V (1014)), control is performed so that a collection quantity of negatively charged toner (1024) into the photosensitive drum 22*b* is increased. Moreover, in the case described above, positively charged toner (1034, 1032) has potential electrically attracted to the potential of the primary transfer rollers 26*a* and 26*b* in both of the cases of the laser light quantity for electrostatic cleaning and the laser light quantity for through. Accordingly, control is performed so that collection into the photosensitive drums 22*a* or 22*b* are prevented.

[Explanation of Flowchart of Example 1]

Figure 5:
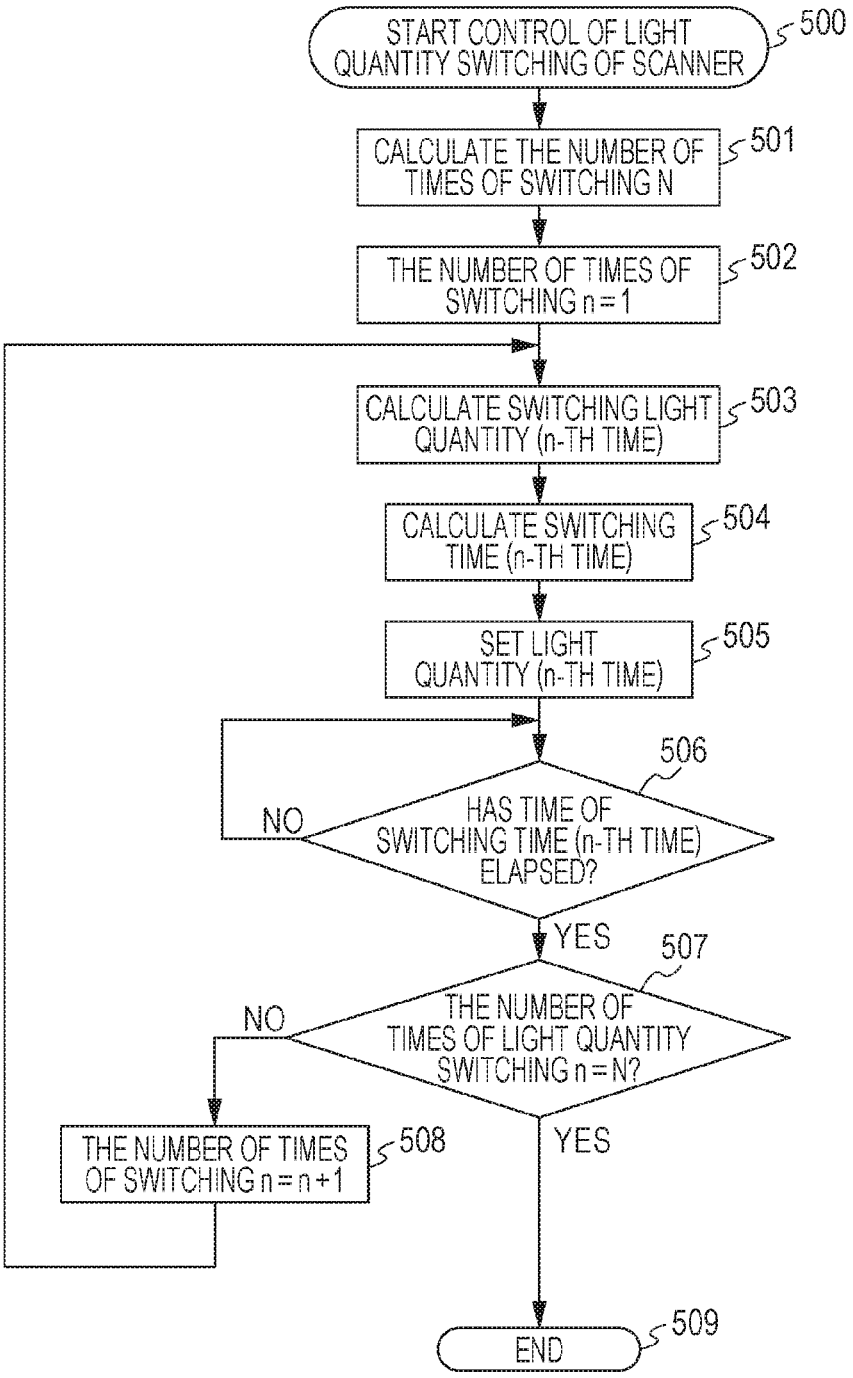
FIG. 5 is a flowchart of control of light quantity switching related to Example 1.

FIG. 5 is a flowchart in a case where the number of times of light quantity switching related to Example 1 is N times. First, in the case of switching the light quantity during regular rotation of the scanner (500), the control unit 300 calculates the number of times of switching N by the laser light quantity calculating unit 320 (501) (the aforementioned formula 1). Next, the laser light quantity calculating unit 320 sets the number of times of switching n=1 (502), and calculates a switching light quantity (n-th time) (503) (the aforementioned formula 3 and formula 4) and a switching time (n-th time) (504). Next, the laser light quantity switching unit 321 sets the switching light quantity (n-th time) (505). Then, the laser light quantity switching unit 321 waits until a time of the switching time (n-th time) elapses (506), and, after the time has elapsed, judges whether to be the number of times of light quantity switching n=N (507). In the case of n<N, by setting the number of times of switching n=n+1 (508), the light quantity is updated by calculation of a switching light quantity (n-th time) (503), and subsequent control is performed. Finally, in the case of n=N, control of light quantity switching ends (509).

The method of performing control so that the BD signal does not become unable to be acquired when switching a light quantity has been described as above. Note that, though Example 1 above has been described for a case where the switching light quantity (n-th time) is a fixed quantity, for example, a case where the switching light quantity is changed according to a fluctuation factor of a circuit is not excluded from the scope of the invention.

Example 2

In Example 1, the case where the laser light quantity switching time is a fixed value has been described. However, in the case where the laser light quantity switching time is the fixed value, it is necessary to consider the manufacturing variations of the element and the variations of the temperature characteristics, so that there is necessity of securing an excessive waiting time. Then, in Example 2, description will be given for control of optimizing the laser light quantity switching time after the regular speed of the scanner is achieved, by measuring the laser light quantity switching time at a time of activating the scanner. Here, since a configuration of the image forming apparatus 10, a configuration of the scanner unit 20, a BDIC circuit configuration, hardware of an engine control unit, and a function according to the engine control unit are same as those of Example 1, description thereof will be omitted.

[Explanation of Timing Chart of Example 2]

Figure 6A:
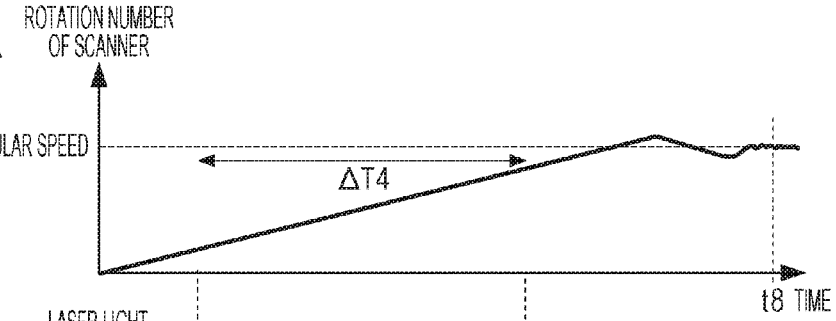
FIGS. 6A to 6D are timing charts of control of measurement of light quantity switching time related to Example 2.
Figure 6B:
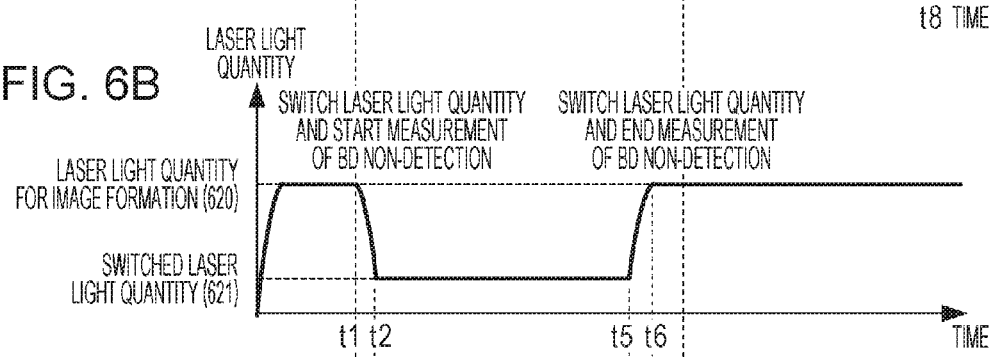
Figure 6C:
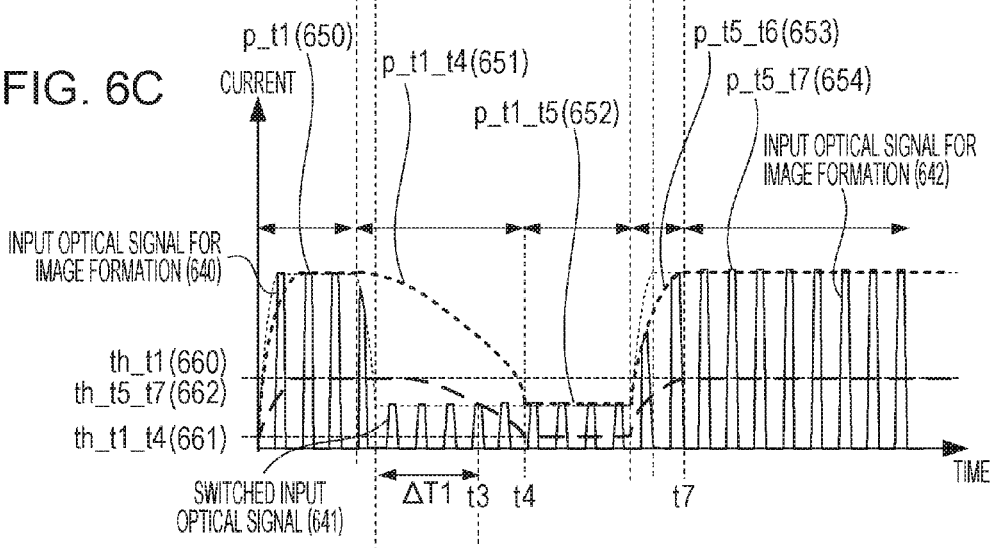
Figure 6D:
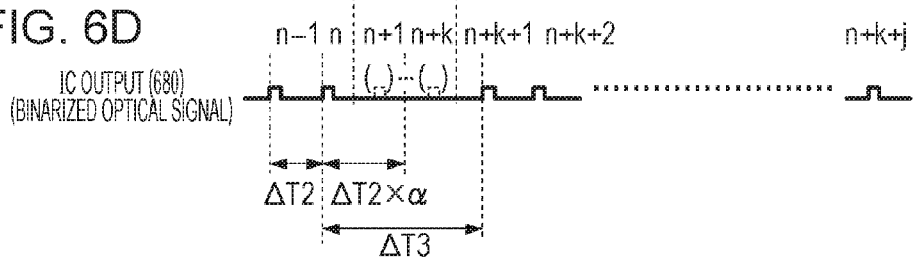

FIG. 6A to 6D are timing charts until the laser light quantity switching time is measured after the scanner is activated, and the scanner has the regular speed. FIG. 6A indicates the rotation speed of the scanner (polygon mirror (202*a*)). FIG. 6B indicates light quantities of the semiconductor laser (201*a*). FIG. 6C indicates a relation of a current which flows when the BDIC (204*a*) is irradiated with light, a peak hold value, and a slice level. FIG. 6D indicates values obtained by binarizing the IC output values (the second output terminal b of FIG. 2A) of the BDIC (204*a*).

First, the control unit 300 activates the scanner motor 331 and sets the laser light quantity for image formation (620). When the scanner motor 331 is activated and the laser light quantity rises, an input optical signal for image formation (640) is input to the BDIC 204*a* in a rotation cycle of the scanner, and the BDIC 204*a* outputs a binarized IC output value (680).

Next, the control unit 300 sets the laser light quantity as a switched laser light quantity (621), which is to use after the regular speed, at a time t1 at which the laser light quantity is stabilized, and starts measurement of the laser light quantity switching time. The laser light quantity is switched to the switched light quantity (621) by a time t2. At this time, the input optical signal for image formation (640), which is input to the BDIC 204*a*, is also switched to a switched input optical signal (641) by the time t2 similarly. Here, since the peak hold circuit holds the peak, a delay occurs with respect to the switched input optical signal (641), which is input to the BDIC 204*a*, until a discharge time of the circuit (time t4) elapses. When taking this delay time into consideration, a peak hold value p_t1_t4 (651) is to be switched by the time t4. Moreover, similarly to a peak hold value p_t1 (650), a slice level th_t1_t4 (661) is also to be switched by the time t4 when the discharge time of the peak hold circuit elapses. At this time, during the time ΔT1 which is from the time t2 to the time t3, the switched input optical signal (641) has a level lower than a slice level th_t1 (660). Accordingly, when BD signals are detected at BD signal timings until n−1-th time and n-th time, the output of the BDIC 204*a* (680) becomes High, but when BD signals are not detected at BD signal timings from n+1-th time to n+k-th time, the output of the BDIC 204*a* (680) becomes Low. Moreover, after a time t3, BD signals are detected at BD signal timings of n+k+1-th time and n+k+2-th time, and the output of the BDIC 204*a* (680) becomes High. At this time, a laser light quantity switching time ΔT3 is obtained by a following formula.

Laser light quantity switching time $\Delta T3$=(timing at which *BD* is detected again (*n*+*k*+1-*th* time))−(timing at which *BD* is lastly detected after light quantity switching (*n-th* time)) (formula 5)

Here, it is defined that the timing at which the BD signal is lastly detected after light quantity switching (n-th time) of the formula 5 above means a case where a BD signal is not detected until a BD signal timing at which next detection is performed. For example, the BD signal timing at which next detection is performed is able to be defined as a previous BD cycle ΔT2×α by using a constant α obtained by taking acceleration of the scanner motor 331 into consideration.

Next, the control unit 300 sets the laser light quantity as the laser light quantity for image formation (620) at a time t5, and ends measurement of the laser light quantity switching time. The laser light quantity is switched to the laser light quantity for image formation (620) by a time t6. At this time, the switched input optical signal (641), which is input to the BDIC 204*a*, is also switched to an input optical signal for image formation (642) by the time t6 similarly. Here, as to the peak hold circuit, a delay occurs with respect to the input optical signal for image formation (642), which is input to the BDIC 204*a*, until a charging time of the circuit (time t7) elapses. When taking this delay time into consideration, a peak hold value (652) is to be switched by the time t7. Moreover, similarly to the peak hold value (652), a slice level th_t5_t7 (662) is also to be switched by the time t7 at which the charging time of the peak hold circuit elapses. At this time, in the case of raising the light quantity, there is no period during which the input optical signal for image formation (642) is lower than the slice level th_t5_t7 (662). Accordingly, without failing to acquire a BD signal, the BDIC 204*a* detects a BD signal at a BD signal detecting timing of n+k+j-th time and outputs High.

The scanner motor 331 thereafter becomes at the regular speed and capable of image formation, at a time t8. In the case of switching the light quantity after the regular speed is achieved, since a control flow of the control unit 300 other than the method of calculating the laser light quantity switching time is same as that of Example 1, only calculation formulas of the laser light quantity switching time will be described below.

[Explanation of View Illustrating Relation of Light Quantity Switching Quantity and Light Quantity Switching Time of Example 2]

Figure 7:
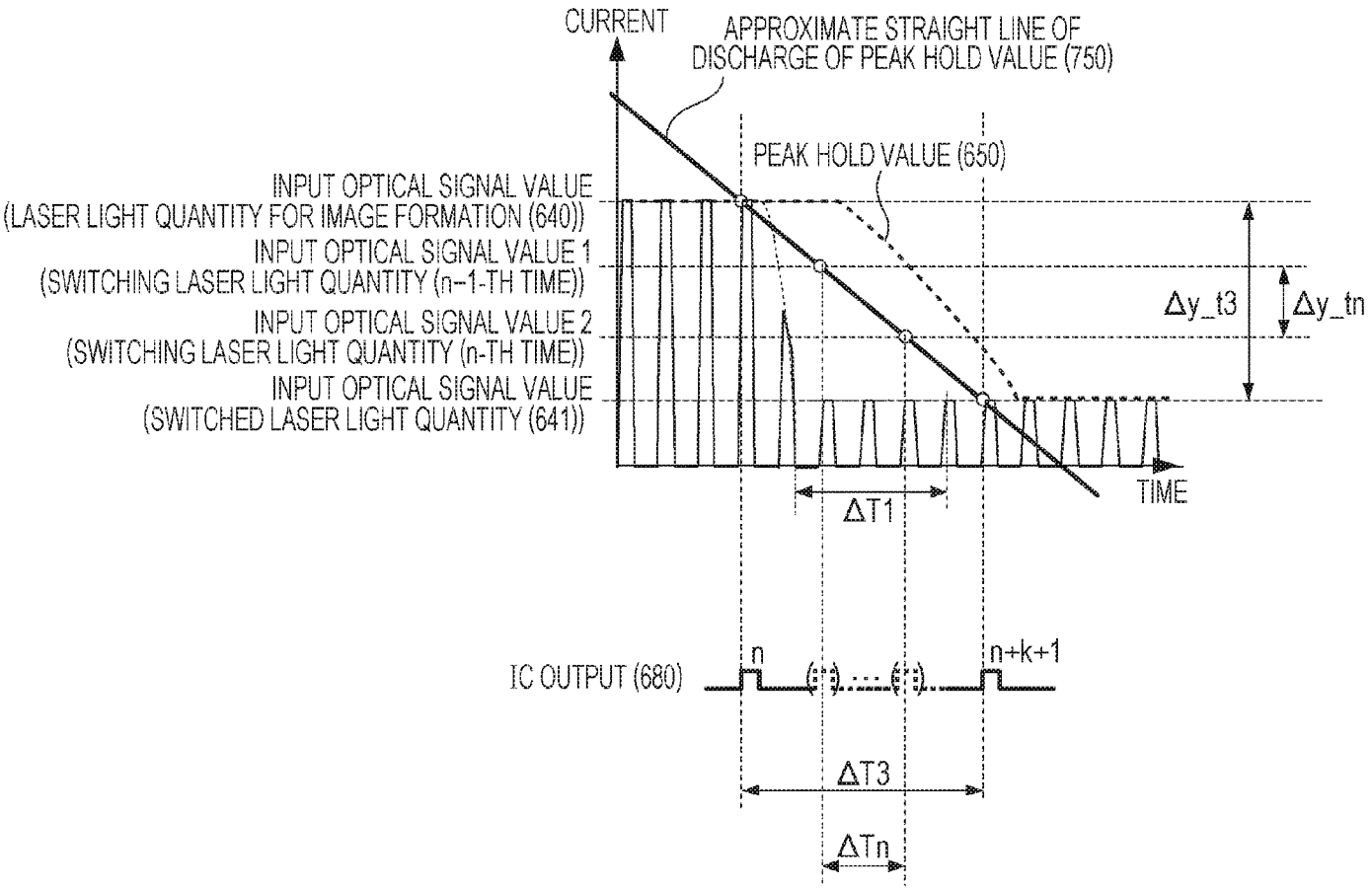
FIG. 7 is a view illustrating a relation between a quantity of light quantity switching and a time of light quantity switching.

FIG. 7 illustrates a relation of the laser light quantity switching time ΔT3 which is measured in FIGS. 6A to 6D, the number of times of laser light quantity switching N of Example 1, and the switching time (n-th time) in a case of the switching light quantity (n-th time). When an input optical signal which is input to the BDIC 204*a* is switched from the laser light quantity for image formation (640) to the switched laser light quantity (641), the laser light quantity switching time becomes the measurement result ΔT3. Here, since the laser light quantity switching time ΔT3 is a time longer than a BD non-detection time ΔT1, even when a discharge time of the peak hold value (650) is approximated by a linear expression (approximate straight line of discharge of a peak hold value (750)), a waiting time is not too short. By using the approximate straight line of discharge of a peak hold value (750), a laser light quantity switching time (n-th time) ΔTn is expressed by following formulas.

Laser light quantity switching time (*n-th* time)$\Delta Tn = (\Delta y_tn/\Delta y_t3)\times\Delta T3$ (formula 6)

Here, $\Delta y_tn$

=input optical signal value 1 (switching light quantity ((*n*−1)-*th* time))−input optical signal value 2 (switching light quantity (*n-th* time)

=switching light quantity ((*n*−1)-*th* time)−switching light quantity (*n-th* time)

=Δswitching light quantity (*n-th* time) (formula 7)

$\Delta y_t3$

=input optical signal (laser light quantity for image formation)−input optical signal (switched laser light quantity)

=laser light quantity for image formation (640)−switched laser light quantity (641)

=Δlight quantity after laser light quantity switching (formula 8)

With the formula 6 above, a time proportional to a width of light quantity switching is to be obtained. By the formula 6 above, the control unit 300 becomes able to optimize the light quantity switching time in accordance with the manufacturing variations of the element or the variations of the temperature characteristics.

[Explanation of Flowchart of Example 2]

Figure 8:
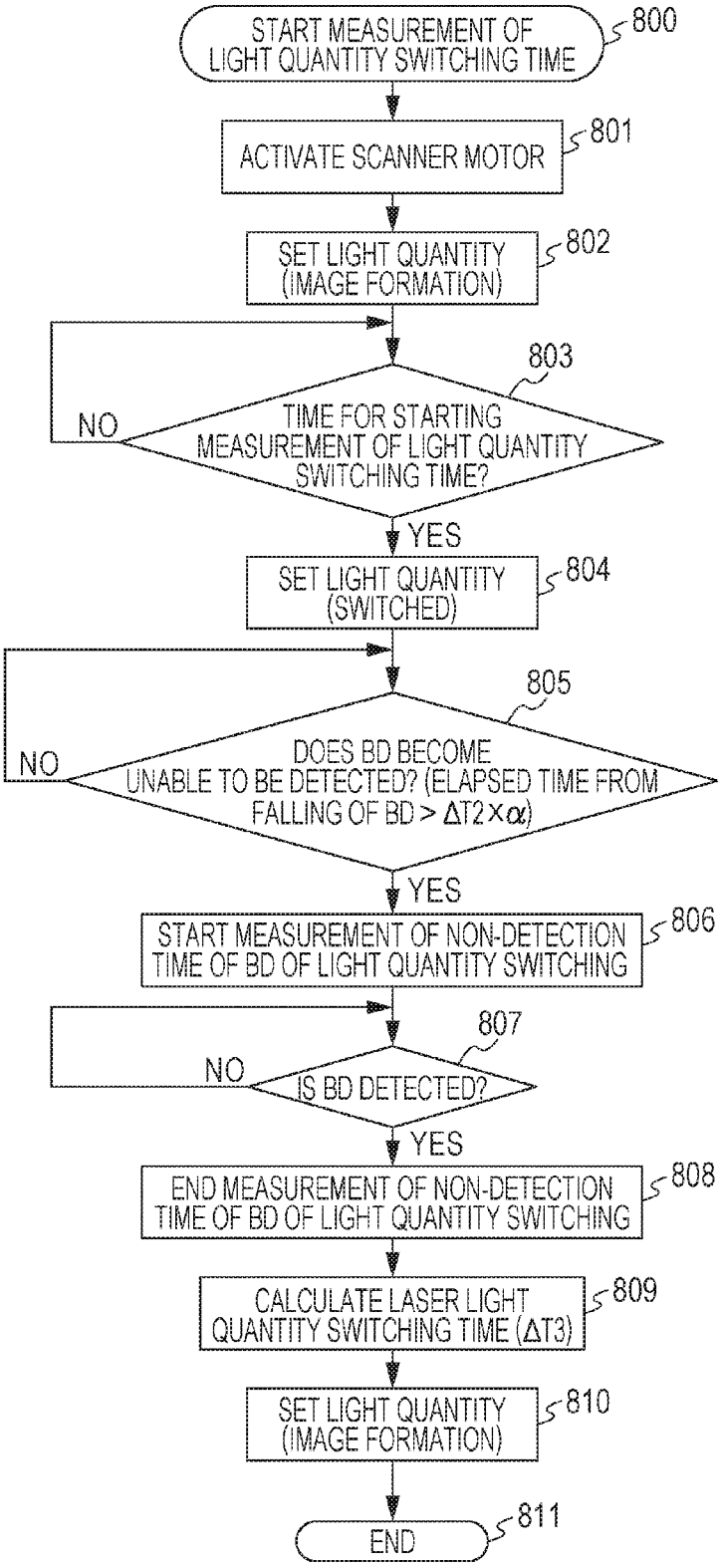
FIG. 8 is a flowchart of control of measurement of light quantity switching time related to Example 2.

FIG. 8 is a flowchart in a case where the laser light quantity switching time is measured at a time of activating the scanner. Since a flowchart in a case where the light quantity is switched after the regular speed is achieved is the same as that of Example 1, description thereof will be omitted.

First, in the case of measuring the laser light quantity switching time (800), the control unit 300 activates the scanner motor 331 (801), and sets the light quantity as the laser light quantity for image formation (802). Next, the control unit 300 waits until a time to start measurement of the light quantity switching time (803), and sets the light quantity as the switched light quantity (804). The control unit 300 then judges whether a BD signal becomes unable to be detected (805), and, after deciding that the BD signal became unable to be detected, starts measurement of a non-detection time of a BD signal of light quantity switching (806). Thereafter, the control unit 300 waits until a BD signal is allowed to be detected (807), and, at a timing when a BD signal is detected, ends the measurement of the non-detection time of a BD signal of light quantity switching (808).

Finally, the control unit 300 calculates a laser light quantity switching time ΔT3 (809), and sets the light quantity as the laser light quantity for image formation (810) to thereby end the measurement of the laser light quantity switching time (811).

As above, description has been given for control of optimizing the light quantity switching time in accordance with the manufacturing variations of the element or the variations of the temperature characteristics by measuring the laser light quantity switching time at a time of activating the scanner. Note that, though the case where the light quantity switching time is approximated by a linear function has been explained in Example 2 described above, a case of using another approximate expression is also not excluded from the scope of the invention. Note that, Examples described above do not limit the invention according to claims, and all of the combinations of the features described in Examples are not always necessary for solution of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-074304, filed Mar. 31, 2015, and Japanese Patent Application No. 2015-239517, filed Dec. 8, 2015, which are hereby incorporated by reference herein in their entirety.

What is claimed is:

1. An image forming apparatus, comprising:

a light source which emits light to a photosensitive member;

a deflection unit which reflects the light emitted from the light source to the photosensitive member to form a latent image;

a light receiving unit configured to receive the light which is emitted from the light source and reflected by the deflection unit;

a signal output unit which outputs a signal based on a value related to the received light;

a light quantity changing unit which changes a light quantity that the light source emits; and a setting unit which sets a threshold for outputting the signal based on the value related to the received light, wherein in a case where the light receiving unit receives light which is emitted from the light source with a first light quantity, the setting unit sets a first threshold based on a value related to a first received light corresponding to the first light quantity, and in a case of changing the first light quantity to a second light quantity which is smaller than the first light quantity, the light quantity changing unit changes the light quantity to a third light quantity, which is smaller than the first light quantity and larger than the second light quantity, before changing the light quantity to the second light quantity, and the third light quantity is a light quantity with which the signal is able to be output in a state where the first threshold is set.

2. The image forming apparatus according to claim 1, wherein, in a case where the light receiving unit receives light which is emitted from the light source with the third light quantity, a value related to a third received light corresponding to the third light quantity is larger than the first threshold.

3. The image forming apparatus according to claim 1, wherein in a case where the light receiving unit receives light which is emitted from the light source with the third light quantity, the setting unit sets a third threshold based on a value related to a third received light corresponding to the third light quantity, and in a case where the light receiving unit receives light which is emitted from the light source with the second light quantity, a value related to a second received light corresponding to the second light quantity is larger than the third threshold.

4. The image forming apparatus according to claim 1, wherein the signal is a horizontal synchronization signal.

5. The image forming apparatus according to claim 1, wherein the deflection unit includes a rotating polygon mirror, and a control unit which controls a rotation speed of the rotating polygon mirror based on the signal output from the signal output unit is provided.

6. The image forming apparatus according to claim 1, further comprising:

a plurality of photosensitive members;

a plurality of developing units which develop latent images, which are formed on the respective plurality of the photosensitive members, as toner images;

a plurality of transfer units which transfer the toner images formed on the respective plurality of photosensitive members onto an intermediate transfer member; and a power supply unit for transfer which applies a voltage commonly to the plurality of transfer units.

7. The image forming apparatus according to claim 1, further comprising:

a plurality of photosensitive members;

a plurality of charging units which respectively charge the plurality of photosensitive members; and a power supply unit for charging which applies a voltage commonly to the plurality of charging units.

8. The image forming apparatus according to claim 1, wherein the light source emits light with the third light quantity at least for a switching time which is equal to or more than a time until the setting unit sets a third threshold based on a value related to a third received light corresponding to the third light quantity.

9. The image forming apparatus according to claim 8, wherein, in a case where the light source emits light with a fourth light quantity and the signal is detected, the fourth light quantity is switched to a fifth light quantity which is smaller than the fourth light quantity, and the light source emits light with the fifth light quantity, a time until the signal in accordance with the fifth light quantity becomes able to be detected after the signal in accordance with the fourth light quantity becomes unable to be detected is set as the switching time.

10. The image forming apparatus according to claim 1, wherein

The photosensitive member includes a first photosensitive member; and a second photosensitive member which is arranged in a downstream side of the first photosensitive member in a rotational direction of an intermediate transfer member, wherein the light source includes a first light source which emits light radiated to the first photosensitive member; and a second light source which emits light radiated to the second photosensitive member, and wherein the light quantity changing unit changes the light quantity to the second light quantity which is smaller than the first light quantity such that toner on the intermediate transfer member is not collected into the first photosensitive member, and the first light source emits light to the first photosensitive member with the second light quantity.

11. The image forming apparatus according to claim 10, wherein the light quantity changing unit changes the light quantity to a light quantity which is larger than the second light quantity such that the toner on the intermediate transfer member is collected into the second photosensitive member, and the second light source emits light to the second photosensitive member with the light quantity which is larger than the second light quantity.

12. An image forming apparatus, comprising:

a light source which emits light to a photosensitive member;

a deflection unit which reflects the light emitted from the light source to the photosensitive member to form a latent image;

a first light receiving unit which receives the light which is emitted from the light source and reflected by the deflection unit;

a second light receiving unit which receives light which is emitted from the light source and not reflected by the deflection unit;

a signal output unit which outputs a signal based on a value related to the light received by the first light receiving unit;

a light quantity changing unit which changes a light quantity that the light source emits; and a setting unit which sets a threshold for outputting the signal based on a value related to a light received by the second light receiving unit, wherein in a case where the second light receiving unit receives light which is emitted from the light source with a first light quantity, the setting unit sets a first threshold based on a value related to a first received light corresponding to the first light quantity, and in a case of changing the first light quantity to a second light quantity which is smaller than the first light quantity, the light quantity changing unit changes the light quantity to a third light quantity, which is smaller than the first light quantity and larger than the second light quantity, before changing the light quantity to the second light quantity, and the third light quantity is a light quantity with which the signal is able to be output in a state where the first threshold is set.

13. An image forming apparatus, comprising:

a light source which emits light to a photosensitive member;

a deflection unit which reflects the light emitted from the light source to the photosensitive member to form a latent image;

a light receiving unit which receives the light which is emitted from the light source and reflected by the deflection unit;

a signal output unit which outputs a signal based on a value related to the received light;

a light quantity changing unit which changes a light quantity that the light source emits; and a setting unit which sets a threshold for outputting the signal based on the value related to the received light, wherein in a case where the light receiving unit receives light which is emitted from the light source with a first light quantity, the setting unit sets a first threshold based on a value related to a first received light corresponding to the first light quantity, and in a case where the light receiving unit receives light which is emitted from the light source with a second light quantity which is smaller than the first light quantity, the setting unit sets a second threshold based on a value related to a second received light corresponding to the second light quantity, in a case of changing the first light quantity to the second light quantity, the light quantity changing unit changes the light quantity to a third light quantity, which is smaller than the first light quantity and larger than the second light quantity, before changing the light quantity to the second light quantity, and in a case where the light receiving unit receives light which is emitted from the light source with the third light quantity, a value related to a third received light corresponding to the third light quantity is larger than the first threshold.

14. An image forming apparatus, comprising:

a light source which emits light to a photosensitive member;

a deflection unit which reflects the light emitted from the light source to the photosensitive member to form a latent image;

a first light receiving unit which receives the light which is emitted from the light source and reflected by the deflection unit;

a second light receiving unit which receives light which is emitted from the light source and not reflected by the deflection unit;

a signal output unit which outputs a signal based on a value related to the light received by the first light receiving unit;

a light quantity changing unit which changes a light quantity that the light source emits; and a setting unit which sets a threshold for outputting the signal based on a value related to a light received by the second light receiving unit, wherein in a case where the second light receiving unit receives light which is emitted from the light source with a first light quantity, the setting unit sets a first threshold based on a value related to a first received light corresponding to the first light quantity, and in a case where the second light receiving unit receives light which is emitted from the light source with a second light quantity which is smaller than the first light quantity, the setting unit sets a second threshold based on a value related to a second received light corresponding to the second light quantity, in a case of changing the first light quantity to the second light quantity, the light quantity changing unit changes the light quantity to a third light quantity, which is smaller than the first light quantity and larger than the second light quantity, before changing the light quantity to the second light quantity, and in a case where the second light receiving unit receives light which is emitted from the light source with the third light quantity, a value related to a third received light corresponding to the third light quantity is larger than the first threshold.

* * * * *